US009343831B2

(12) United States Patent
Ozeki

(10) Patent No.: US 9,343,831 B2
(45) Date of Patent: May 17, 2016

(54) ELECTRICAL CONNECTOR

(71) Applicant: Dai-ichi Seiko Co., Ltd., Kyoto-shi, Kyoto (JP)

(72) Inventor: Kosuke Ozeki, Ogori (JP)

(73) Assignee: DAI-ICHI SEIKO CO., LTD., Kyoto-Shi, Kyoto (JP)

( * ) Notice: Subject to any disclaimer, the term of this patent is extended or adjusted under 35 U.S.C. 154(b) by 0 days.

(21) Appl. No.: 14/575,054

(22) Filed: Dec. 18, 2014

(65) Prior Publication Data

US 2015/0188255 A1 Jul. 2, 2015

(30) Foreign Application Priority Data

Dec. 27, 2013 (JP) ..... 2013-271672

(51) Int. Cl.
*H01R 12/71* (2011.01)
*H01R 12/70* (2011.01)
*H01R 12/79* (2011.01)

(52) U.S. Cl.
CPC ..... *H01R 12/716* (2013.01); *H01R 12/7029* (2013.01); *H01R 12/79* (2013.01)

(58) Field of Classification Search
USPC ..... 439/364, 372, 74, 67, 357, 345
See application file for complete search history.

(56) References Cited

U.S. PATENT DOCUMENTS 4,929,185 A * 5/1990 Wong ..... H01R 12/52 361/810
5,380,211 A * 1/1995 Kawaguchi ..... H01R 4/30 439/581
7,094,072 B2 * 8/2006 Takase ..... H01R 12/7023 361/752
7,223,106 B2 * 5/2007 Nakajima ..... H01R 12/716 411/178
7,331,798 B2 * 2/2008 Yoshida ..... H01R 12/7005 439/67
8,257,095 B2 * 9/2012 Akai ..... H01R 12/716 439/248
9,124,011 B2 * 9/2015 Miyazaki ..... H01R 12/716
2002/0016092 A1 * 2/2002 Dibene, II ..... G06F 1/18 439/74
2010/0248520 A1 * 9/2010 Miyazaki ..... H01R 12/716 439/345
2013/0012039 A1 * 1/2013 Nose ..... H01R 12/716 439/74

(Continued)

FOREIGN PATENT DOCUMENTS

JP H6-28194 B2 4/1994
JP 2000-150034 A 5/2000

(Continued)

OTHER PUBLICATIONS

Japanese Office Action (JP 2013-271672); Dispatch Date: May 7, 2015.

*Primary Examiner* — Alexander Gilman
(74) *Attorney, Agent, or Firm* — Howard & Howard Attorneys PLLC

(57) ABSTRACT

Into one housing, another housing interlocks, and a penetrating hole into which a lock member for maintaining the interlocking state between the connectors is insertable and from which the inserted lock member is removable when releasing the interlocking state is formed in the other housing. A lock section is attached at a position corresponding to the penetrating hole in the inner wall of the one housing facing the other housing when the connectors are interlocked with each other, and is composed to be lockable with the lock member inserted into the penetrating hole. A connector is a pair of members attached to both ends of the lock section facing each other so as to interpose the lock section in between, and is connected to a circuit board positioned on the outside of the first housing in a state covering a portion of the one housing along with the lock section.

4 Claims, 15 Drawing Sheets

(56) References Cited

U.S. PATENT DOCUMENTS

| | | | | |
|---|---|---|---|---|
| 2013/0330943 | A1* | 12/2013 | Sasaki | H01R 13/631 439/74 |
| 2014/0227899 | A1* | 8/2014 | Tanaka | H01R 13/6271 439/357 |

FOREIGN PATENT DOCUMENTS

| | | | |
|---|---|---|---|
| JP | 2008-251205 | A | 10/2008 |
| JP | 2011-065861 | A | 3/2011 |
| JP | 4789576 | B2 | 10/2011 |
| JP | 2013-125624 | A | 6/2013 |

* cited by examiner

ELECTRICAL CONNECTOR

CROSS-REFERENCE TO RELATED APPLICATION

This application claims the benefit of Japanese Patent Application No. 2013-271672, filed on Dec. 27, 2013, the entire disclosure of which is incorporated by reference herein.

FIELD

This application relates generally to an electrical connector.

BACKGROUND

As an electrical connector that electrically connects a circuit board on which one connector is mounted and a circuit board on which another connector is mounted, by causing the two connectors structured so as to be capable of interlocking to interlock, the electrical connector disclosed for example in Patent Literature 1 is known.

This electrical connector comprises a plug reinforcement fitting provided on a plug connector and a receptacle reinforcement fitting provided on a receptacle connector. An operator interlocks both connectors, and by causing an engagement protrusion of the plug reinforcement fitting to be engaged with an engagement hole in the receptacle reinforcement fitting, the plug connector and the receptacle connector achieve a locked state (a state in which interlocking is maintained).

When releasing the interlocking of the plug connector and the receptacle connector, the operator first inserts the tip of a scissors-like jig into a release hole of the circuit board on which the plug connector is mounted. The operator inserts the tip of the jig into a jig insertion hole provided in the receptacle reinforcement fitting. Then the operator operates the jig, causes the plug reinforcement fitting to elastically deform and separates the engagement protrusion of the plug reinforcement fitting from the engagement hole of the receptacle reinforcement fitting, and through this releases the engagement of the engagement protrusion with the engagement hole. When maintaining this state, the operator releases the interlocking of the plug connector and the receptacle connector by pulling apart the plug connector and the receptacle connector.

Hence, with the electrical connector disclosed in Patent Literature 1, it is possible to prevent the engagement between the engagement protrusion and the engagement hole from being erroneously released through an unanticipated action of the operator, for example.

CITATION LIST

Patent Literature

Patent Literature 1: Unexamined Japanese Patent Application Kokai Publication No. 2011-65861.

SUMMARY

With the electrical connector disclosed in Patent Literature 1, when releasing interlocking of the plug connector and the receptacle connector, the operator as described above inserts the tip of the scissors-like jig into the release hole of the circuit board, inserts the receptacle reinforcement fitting into the jig insertion hole and furthermore operates the jig and must maintain the state with the plug reinforcement fitting elastically deformed.

Hence, with the electrical connector disclosed in Patent Literature 1, the problem exists that releasing interlocking between the connectors is troublesome.

In consideration of the foregoing, it is an objective of the present discloser to provide an electrical connector with which it is possible to securely maintain the interlock between connectors and releasing of the interlock between connectors is easy.

Solution to Problem

In order to achieve the above objective, the electrical connector according to the present disclosure comprises:

a first connector possessing a first housing forming an interior region with an insulating wall, and first contacts that are conductive members extending toward the outside of the first housing from the wall of the interior region; and a second connector possessing a second housing made up of an insulating wall at least a portion of which is positioned within the interior region of the first housing, and second contacts that are conductive members extending toward the outside of the second housing from the wall of the second housing, wherein the first housing and the second housing are interlocked and through this the first contacts and the second contacts are electrically connected, and into one housing the other housing interlocks, and a penetrating hole into which a lock member for maintaining the interlocking state between the connectors is insertable and from which the inserted lock member is removable when releasing the interlocking state is formed in the other housing, the electrical connector further comprising:

a lock section attached at a position corresponding to the penetrating hole in the inner wall of the one housing facing the other housing when the connectors are interlocked with each other, and composed so as to be lockable with the lock member inserted into the penetrating hole; and a connecting member that is a pair of members attached to both ends of the lock section facing each other so as to interpose the lock section in between, and is connected to a circuit board positioned on the outside of the one housing in a state covering a portion of the one housing along with the lock section.

In addition, a compartment forming a hole for holding the lock section when the connectors are interlocked with each other is provided in the other housing.

In addition, the first contacts are laid out on both ends of the first housing;

the second contacts are laid out on both ends of the second housing corresponding to the layout of the first contacts, and the lock section and the connector are positioned between the contacts laid out at one end of the one housing and the contacts laid out at the other end of the one housing.

In addition, the lock member is a screw, and a groove into which the screw is lockable is formed in the lock section.

In addition, the lock section and the connector are integrally formed, and the one connector comprises at least two of the integrally formed lock sections and connecting members.

When causing the housings to interlock, it is fine for the operator to insert a lock member into a penetrating hole and cause locking of the lock member with a lock section provided on a connector connected to a circuit board. On the other hand, when releasing the interlocking state between the housings, it is fine for the operator to release the lock between the lock member and the lock section and to remove the lock member from the penetrating hole. Accordingly, with the electrical connector according to the present disclosure, it is possible to securely maintain interlocking of the connectors with each other and it is also easy to release interlocking of the connectors with each other.

BRIEF DESCRIPTION OF THE DRAWINGS

A more complete understanding of this application can be obtained when the following detailed description is considered in conjunction with the following drawings, in which.

DETAILED DESCRIPTION

Figure 1:
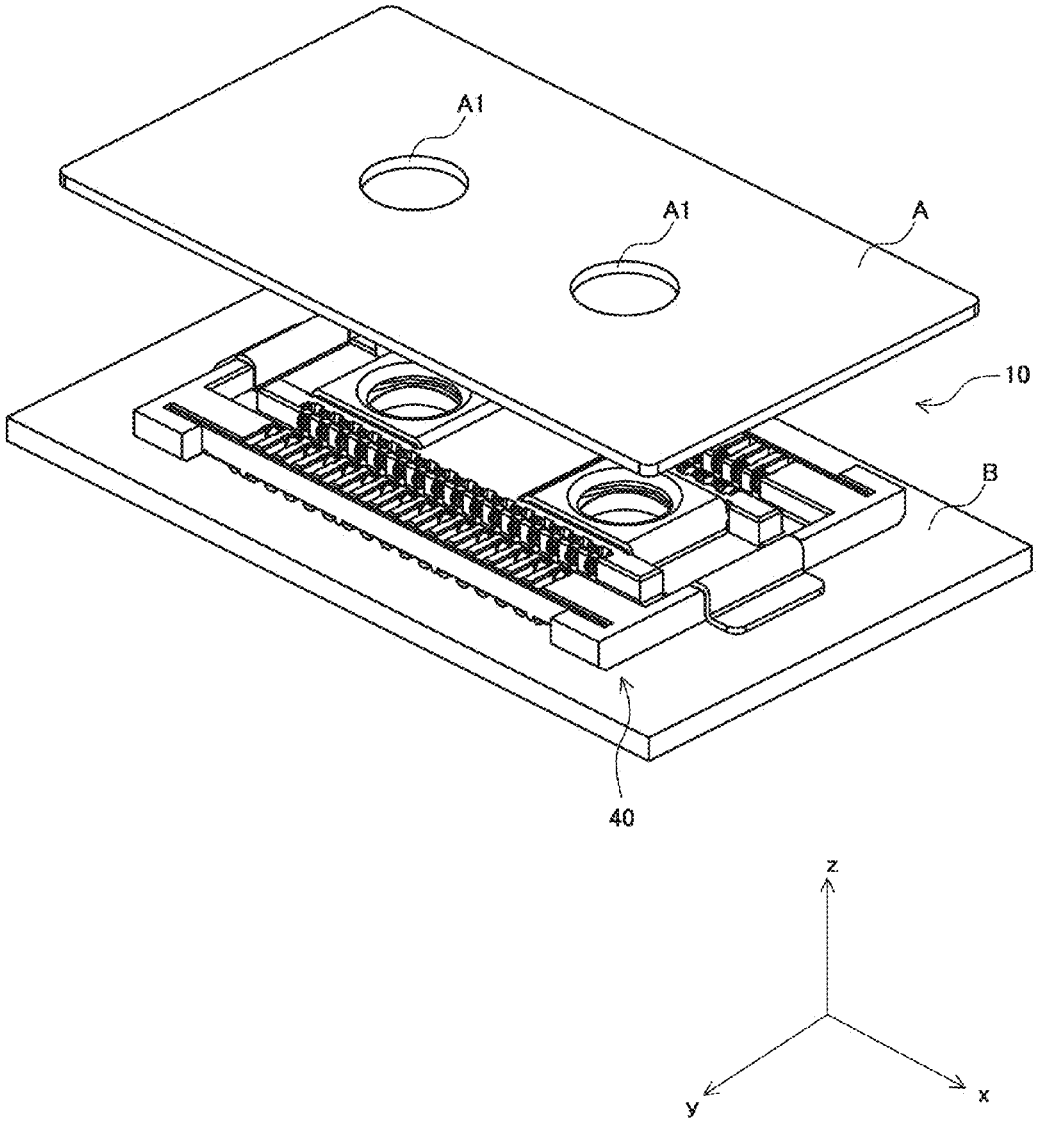
FIG. 1 is a first oblique view of the electrical connector according to an exemplary embodiment of the present disclosure when mounted on a circuit board.

Below, an electrical connector 10 according to an exemplary embodiment of the present disclosure is described. The electrical connector 10 comprises a plug connector 20 and a receptacle connector 40 that interlocks with the plug connector 20, as shown in the oblique views in FIGS. 1 and 2. (FIG. 1 is a drawing viewing the plug connector 20 from the receptacle connector 40 side). The plug connector 20 and the receptacle connector 40 are each mounted on a circuit board.

When the electrical connector 10 is assembled, an operator interlocks the plug connector 20 into the receptacle connector 40. Then, the operator completes assembly by screwing the plug connector 20 together with the receptacle connector 40 using general-purpose screws G, as shown in the oblique view in FIG. 3.

Figure 4:
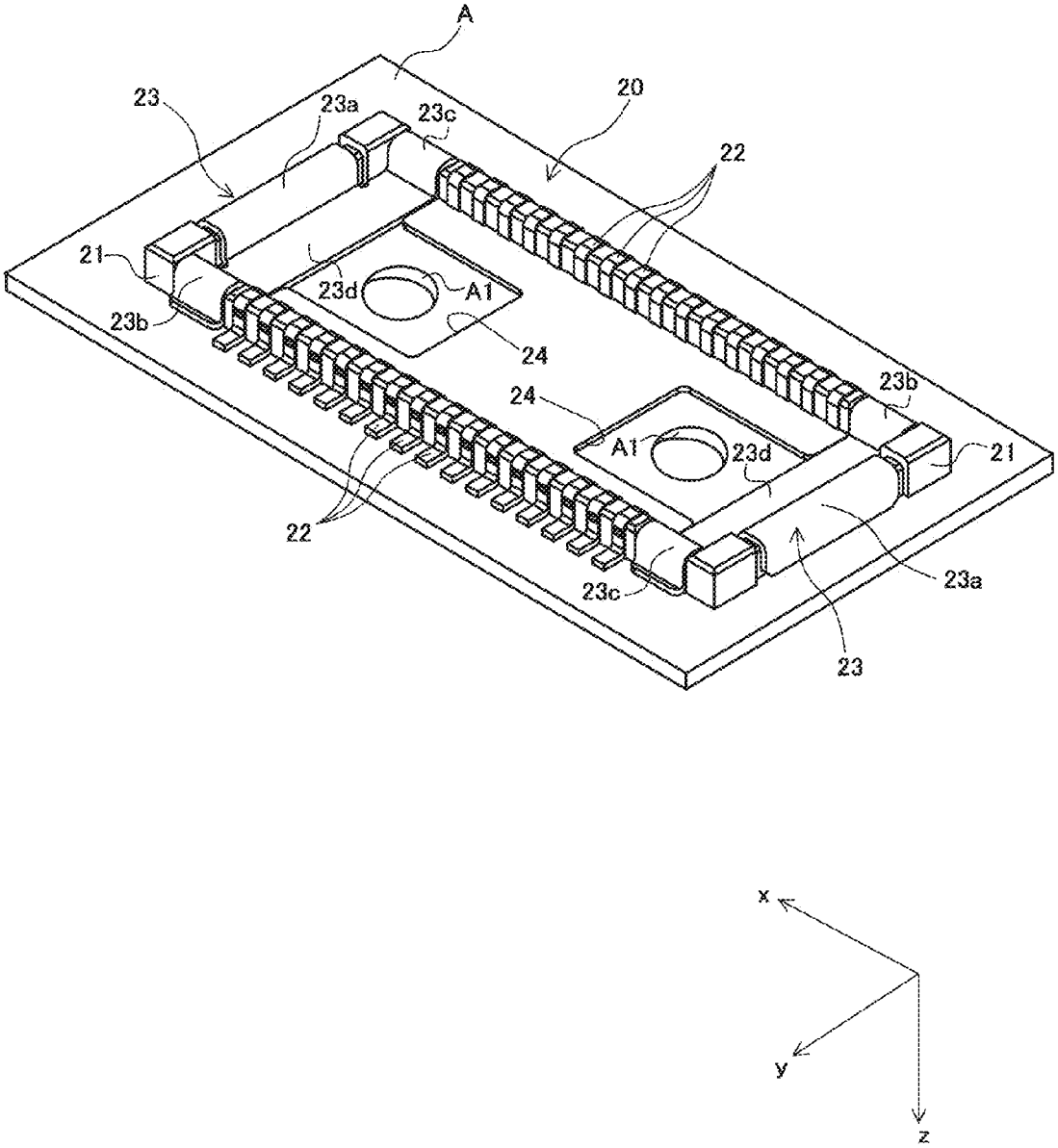
FIG. 4 is an oblique view of a plug connector in a state mounted on a circuit board.

The plug connector 20 is a rectangular frame at least partially positioned within the interior region of the receptacle connector 40, and comprises a plug housing 21 composed of an insulating wall (for example, a plastic wall and/or the like), as shown in the oblique view in FIG. 4. The plug housing 21 is positioned on the xy plane.

In addition, the plug connector 20 has plug contacts 22 that are conductive members (for example, a copper alloy plate material and/or the like) extending toward the outside of the plug housing 21, following the outer wall of the plug housing 21 from the inner wall of the plug housing 21. The plug contacts 22 are for example soldered to electrodes of a flexible board A that is highly flexible.

In addition, the plug connector 20 comprises a pair of anchoring members 23 formed of metal plates, for example. The pair of anchoring members 23 is respectively positioned at the ends of the plug housing 21 positioned in the lengthwise direction (the pitch direction in which the plug contacts 22 are laid out) of the plug housing 21.

The pair of anchoring members 23 comprises an overhang 23*a* having a roughly U-shaped cross-section. In addition, the pair of anchoring members 23 comprises overhangs 23*b* and 23*c* each having roughly U-shaped cross sections, overhanging in the −z direction. In addition, the pair of anchoring members 23 comprises a plate 23*d* positioned between the ends of the plug housing 21 on which the plug contacts 22 are laid out. One end of each of the overhangs 23*a* to 23*c* is connected to an end of the plate 23*d*.

The overhang 23*a* is positioned so as to cover the end of the plug housing 21 positioned in the lengthwise direction of the plug housing 21 (the end of the plug housing 21 on which the plug contacts 22 are not laid out).

In addition, the overhang 23*b* is positioned so as to cover one of the ends of the plug housing 21 positioned in the short direction of the plug housing 21 (one of the ends of the plug housing 21 on which the plug contacts 22 are laid out).

Furthermore, the overhang 23*c* is positioned so as to cover the other one of the ends of the plug housing 21 positioned in the short direction of the plug housing 21 (the other one of the ends of the plug housing 21 on which the plug contacts 22 are laid out).

The overhangs 23*b* and 23*c* are both such that the part toward along the outside of the plug housing 21 is soldered to a metal layer (for example, a conductive path and/or the like) of the flexible board A.

Figure 5:
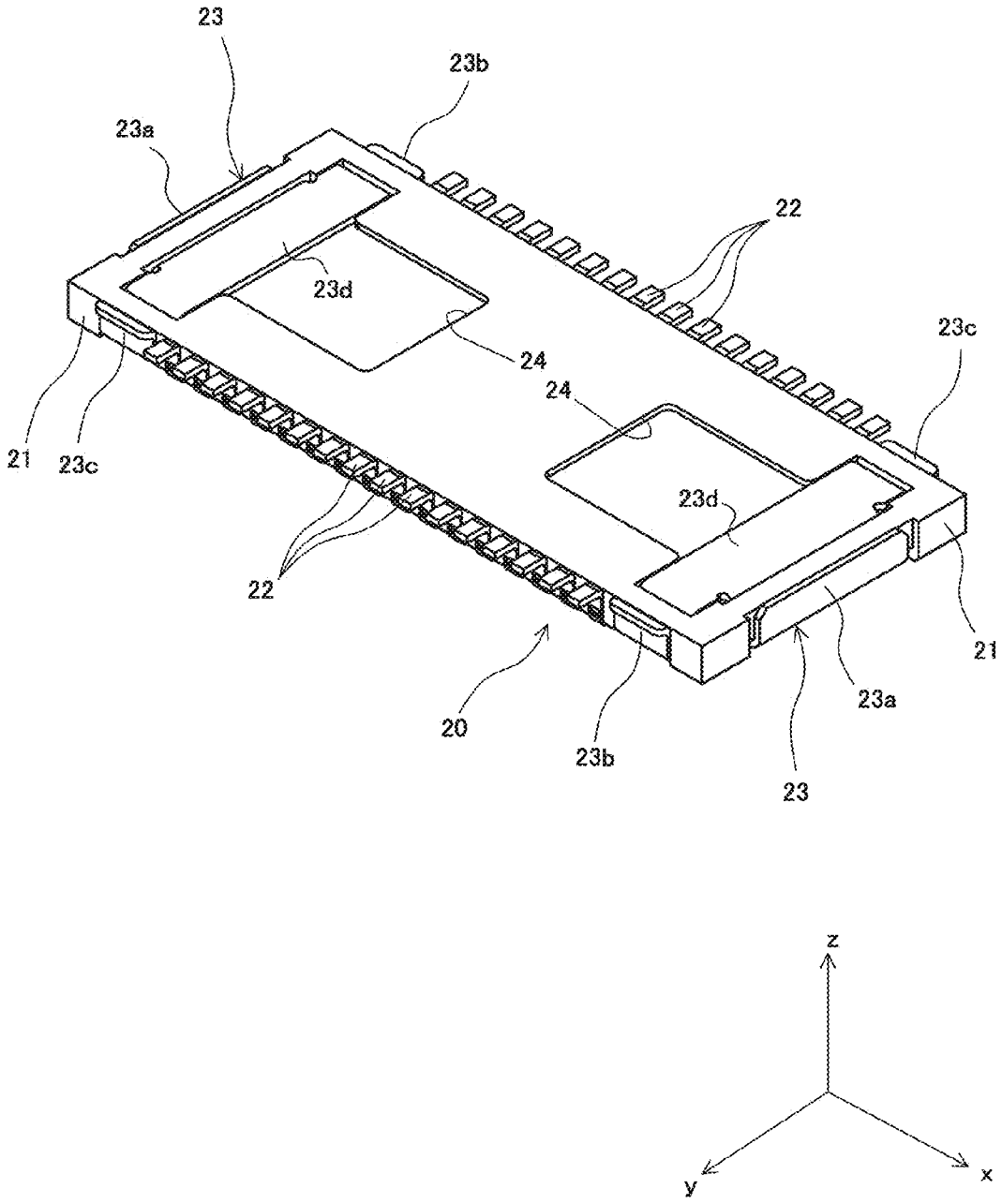
FIG. 5 is an oblique view of the plug connector alone.

In addition, the plate 23*d* connected to the overhangs 23*a* to 23*c* is exposed to the outside of the plug housing 21, as shown in the oblique view in FIG. 5 (FIG. 1 being a view of the plug connector 20 alone as seen from a position on the z axis higher than the position of the flexible board A). This exposed area is soldered to a metal layer (for example, a conductive path and/or the like) of the flexible board A.

In the plug housing 21, a pair of compartments 24 forming rectangular holes are provided as shown in the oblique views in FIGS. 4 and 5. The pair of compartments 24 is provided by the wall being carved out. The pair of compartments 24 is positioned between the ends on which the plug contacts 22 are laid out, and between the ends where the anchoring member 23 is positioned.

When the connectors are interlocked with each other, the compartments 24 form a space holding a below-described lock sections 45 (a member composed so as to be capable of locking with the general-purpose screw G). In addition, the compartments 24 form a penetrating hole into which the general-purpose screws G can be inserted and from which the inserted general-purpose screws G can be pulled out. The general-purpose screws G interlock one housing with the other housing, and maintain the interlocking status (locked status) between the connectors.

In the flexible board A, a hole A1 (a hole whose axis center is along the z-axis) for inserting the general-purpose screw G is provided at a position corresponding to the compartment 24 when mounted on the plug connector 20 (for example, in the center of the compartment 24) as is shown in the oblique view in FIG. 4.

Figure 6:
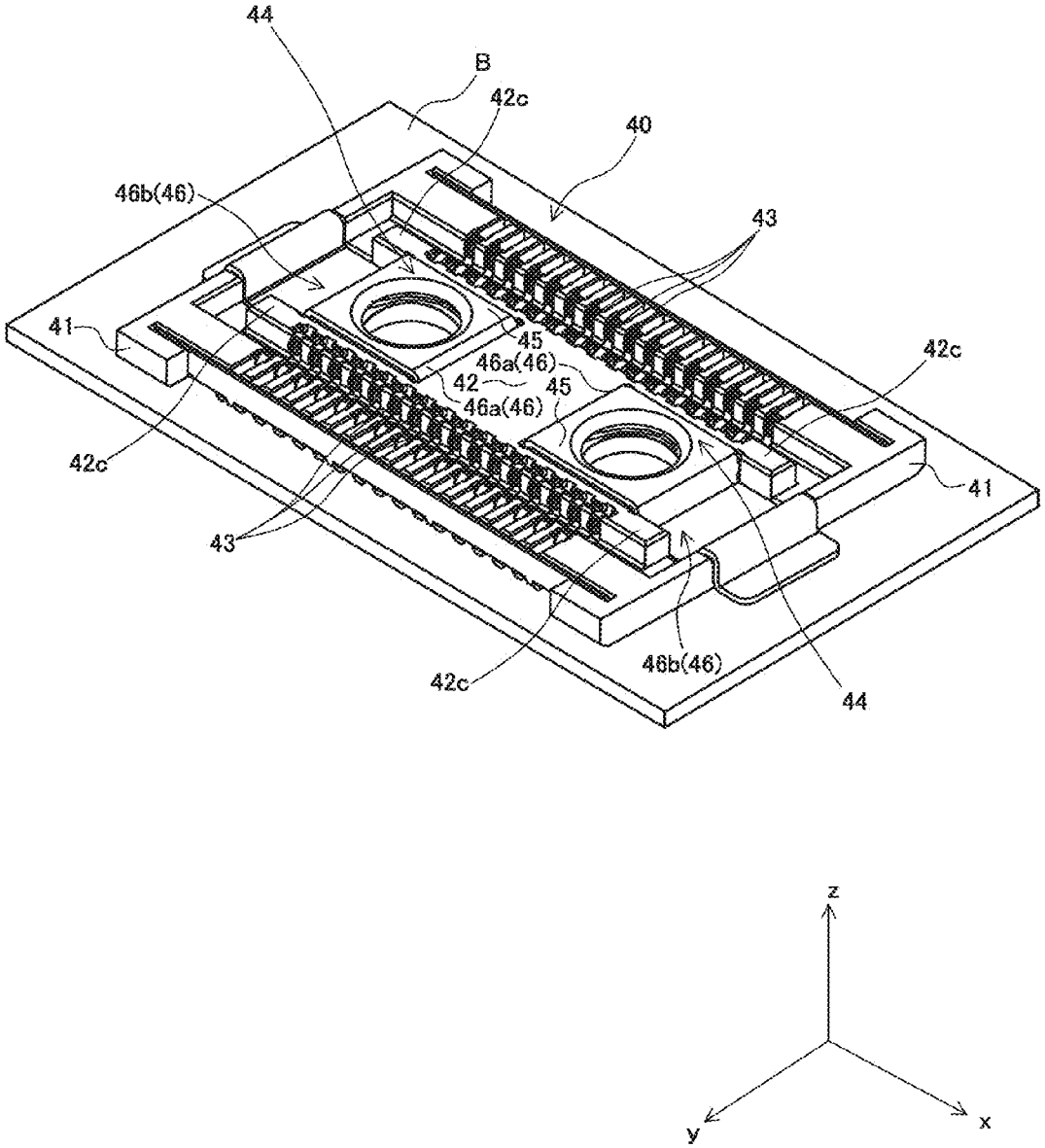
FIG. 6 is an oblique view of a receptacle connector in a state mounted on a circuit board.

The receptacle connector 40 comprises a receptacle housing 41 that is a roughly rectangular frame with the interior region for housing the plug housing 21 formed by an insulating wall (for example, a plastic wall and/or the like), as shown in the oblique view in FIG. 6. The receptacle housing 41 is positioned on the xy plane.

The receptacle housing 41 comprises an integrally formed roughly rectangular-solid-shaped block 42 in the space surrounded by the outer frame. In the interior region formed by the block 42 and the receptacle housing 41, the plug housing 21 is housed.

In addition, the receptacle connector 40 comprises receptacle contacts 43 that are conductive members (for example, a copper alloy plate material and/or the like) extending toward the outside of the receptacle housing 41 along the wall of the receptacle housing 41 from the wall of the block 42. The receptacle contacts 43 are laid out on both ends of the receptacle housing 41 corresponding to the layout of the plug contacts 22. The receptacle contacts 43 are soldered to an electrode of a circuit board B with low flexibility, for example.

In addition, the receptacle connector 40 comprises a pair of lock members 44 formed integrally of metal plates, for example. The pair of lock members 44 is positioned between the blocks 42 on which the receptacle contacts 43 are laid out.

Each of the pair of lock members 44 comprises a lock section 45 comprised so as to lock with the general-purpose screw G, as shown in the oblique view in FIG. 6. In addition, each of the pair of lock members 44 comprises a connecting member 46 made up of a pair of members (a first connecting member 46*a* and a second connecting member 46*b*) attached at both ends of the lock section 45 facing so that the lock section 45 is interposed in between.

Each lock section 45 is positioned on the inner wall of the receptacle housing 41, specifically on the top wall (the xy plane) of the block 42. Each lock section 45 has a cylinder formed therein by a burring process being conducted.

Figure 2:
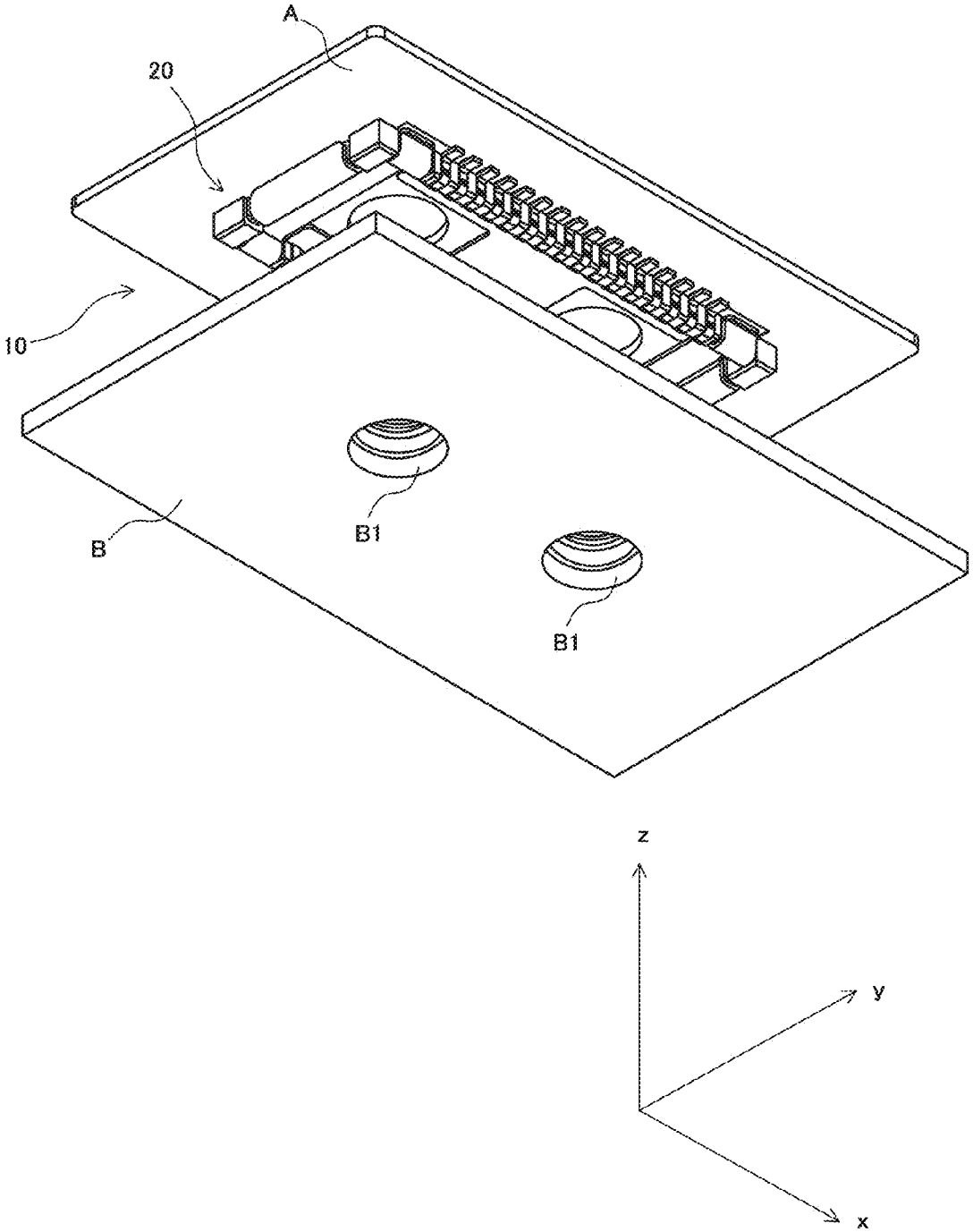
FIG. 2 is a second oblique view of the electrical connector when mounted on a circuit board.
Figure 7:
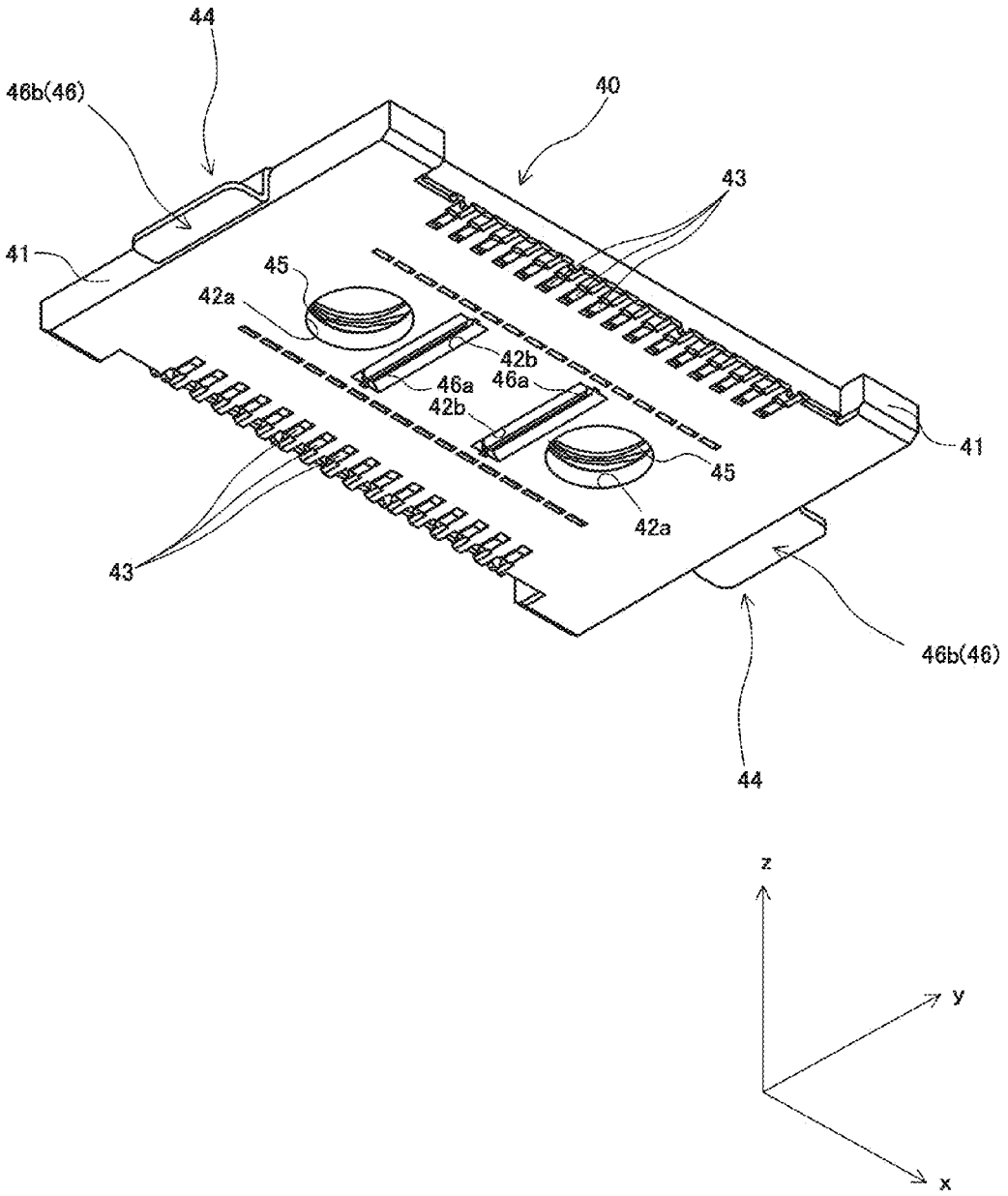
FIG. 7 is an oblique view of the receptacle connector alone.

The inner peripheral wall of each lock section 45 forming the cylinder has inserted therein a penetrating hole 42*a* (a hole with the axis center along the z-axis) provided in advance on the block 42, as shown in the oblique view (a view of the receptacle connector 40 alone as seen from a position on the z-axis lower than the position of the circuit board B in FIG. 2) in FIG. 7. Through this, each lock section 45 has formed therein an opening for inserting a general-purpose screw G.

When the receptacle connector 40 and the plug connector 20 are interlocked, each lock section 45 is positioned such that an opening exists at the position corresponding to the hole A1 of the flexible board A and the compartment 24.

Figure 8:
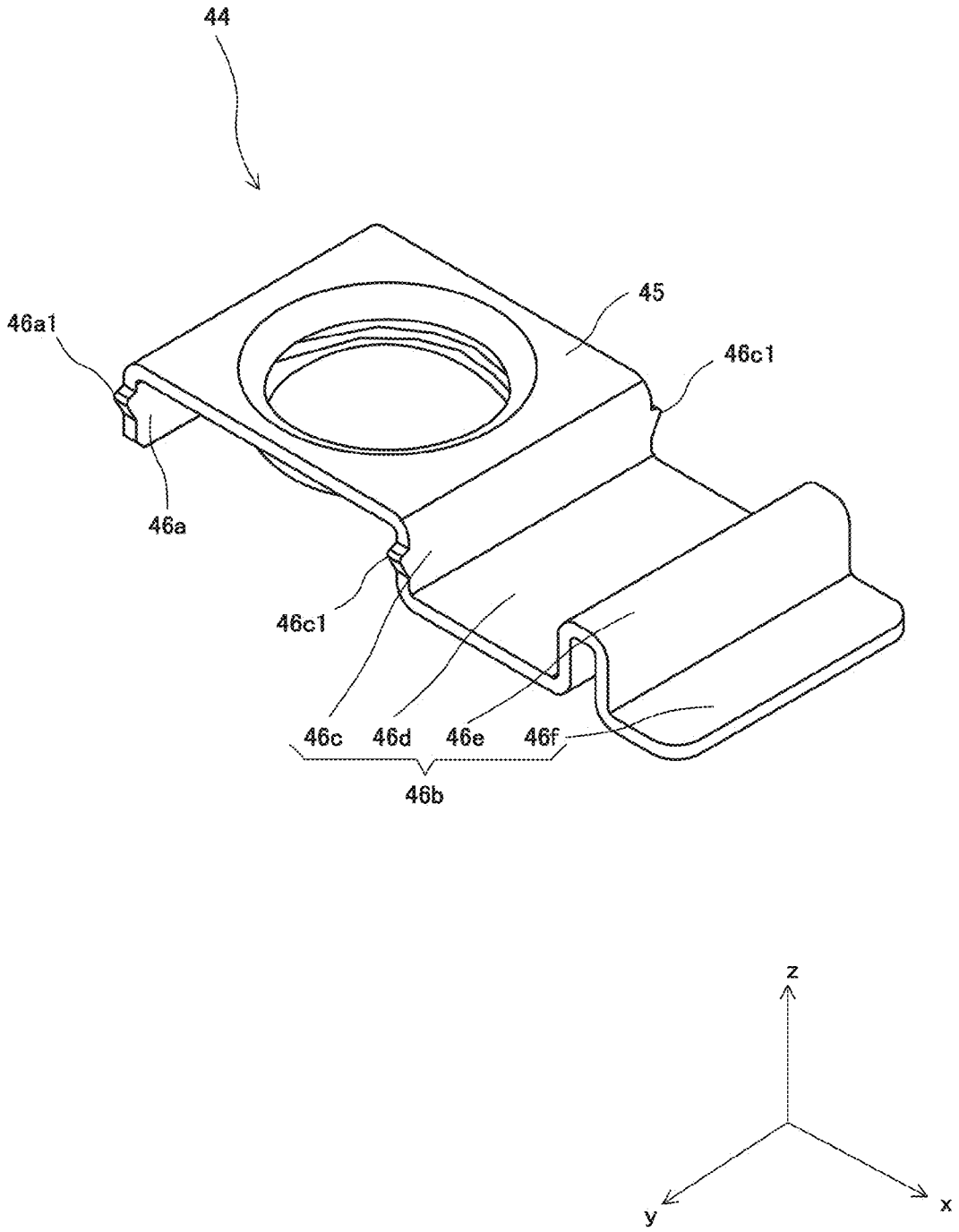
FIG. 8 is a first oblique view of a lock member alone.
Figure 9:
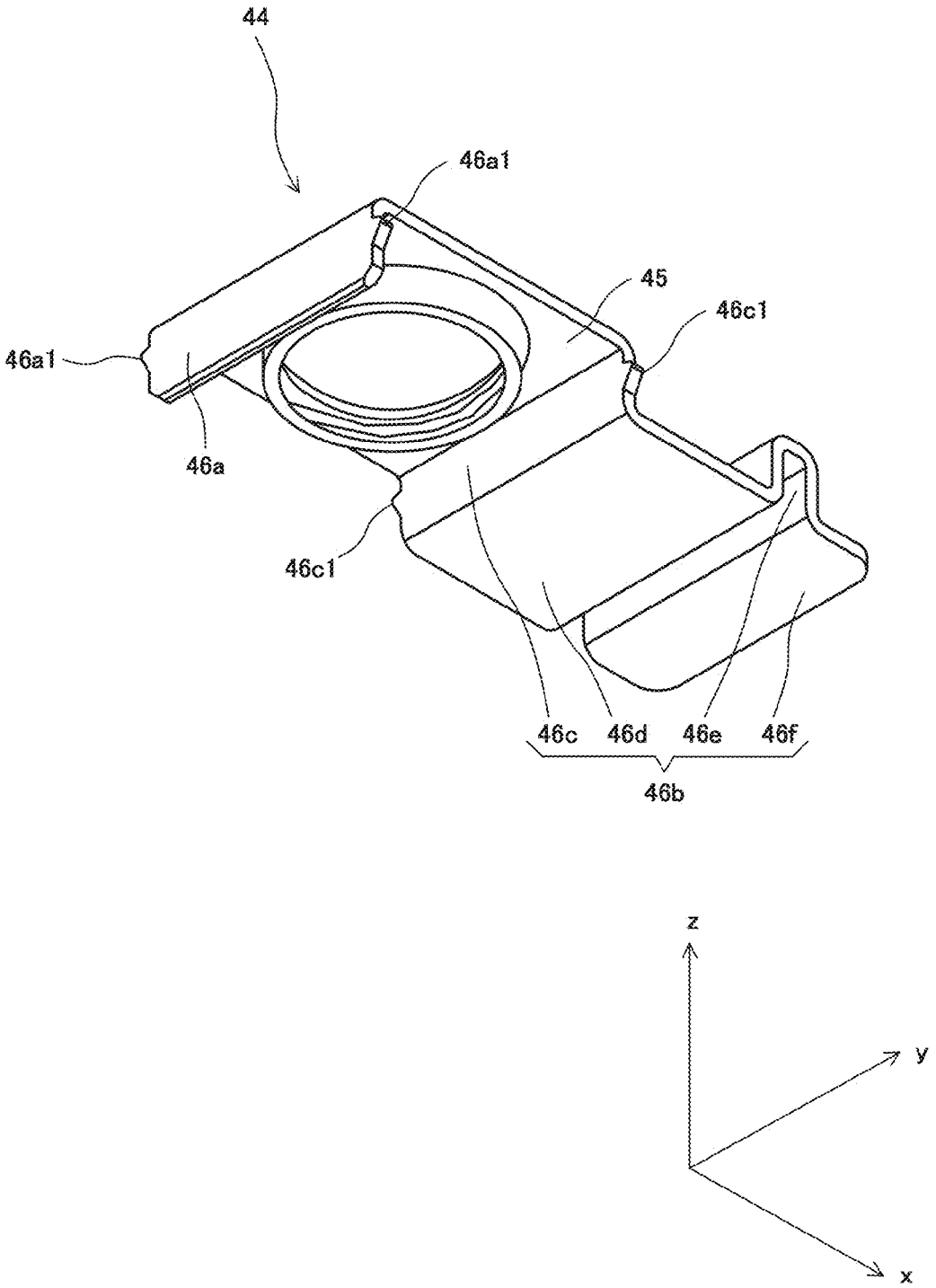
FIG. 9 is a second oblique view of the lock member alone.

In addition, in the inner wall of each lock section 45, grooves are formed for realizing engaging (locking) with the general-purpose screw G, as shown in the oblique views in FIGS. 8 and 9 (in FIG. 8, the view is of the lock member 44 as seen from a position on the −z axis).

The first connecting member 46*a* of each connecting member 46 is a plate-shaped member one end of which is connected to one end of each lock section 45, as shown in the oblique views in FIGS. 6 through 8. The first connecting member 46*a* is positioned on the yz plane of the block 42. Specifically, the first connecting member 46*a* is fastened into a penetrating groove 42*b* formed in advance in the block 42, as shown in the oblique view in FIG. 7.

The penetrating groove 42*b* is a pair of grooves extending along the z-axis formed so that each first connecting member 46*a* can be fastened, between the ends of the block 42 on which the receptacle contacts 43 are laid out.

In the first connecting member 46*a*, protrusions 46*a*1 protruding in the ±y directions are formed, as shown in the oblique views in FIGS. 8 and 9. The protrusions 46*a*1 are pressed into the block 42 inside the penetrating groove 42*b*. Hence, the first connecting member 46*a* is firmly anchored to the block 42.

In addition, the other end (the end not connected to one end of the lock section 45) of the first connecting member 46*a* is exposed to the outside of the receptacle housing 41, as shown in the oblique view in FIG. 7. The other end of the first connecting member 46*a* is soldered (connected) to a metal layer (for example, a conductor and/or the like) of the circuit board B positioned on the outside of the receptacle housing 41.

The second connecting member 46*b* of each connecting member 46 is a member one end of which is connected to the other end of the lock section 45, as shown in the oblique views in FIGS. 6 to 8. The second connecting member 46*b* comprises, as shown in the oblique view of FIG. 8, a plate-shaped standing plate 46*c* positioned at the end of the block 42 on the yz plane, one end of which is connected to the other end of the lock section 45, and a plate-shaped foundation 46*d* positioned on the inner wall of the receptacle housing 41 on the xy plane, one end of which is connected to the other end of the standing plate 46*c*.

In addition, the second connecting member 46*b* comprises an overhang 46*e* overhanging in the +z direction, one end of which is connected to the other end of the foundation 46*d*, and a board connector 46*f* positioned on the xy plane of the circuit board B, one end of which is connected to the other end of the overhang 46*e*.

On the standing plate 46*c*, protrusions 46*c*1 protruding in the ±y directions are formed, as shown in the oblique views in FIGS. 8 and 9. The protrusions 46*c*1 are each positioned at the four corners of the block 42, as shown in the oblique view in FIG. 6, and are pressed into protrusions 42*c* protruding in the ±x directions. Hence, the standing plate 46*c* is firmly anchored to the block 42.

In addition, the overhang 46*e* has a cross-section that is roughly U-shaped, and is positioned so as to cover the end of the receptacle housing 41 positioned in the lengthwise direction (the pitch direction in which the receptacle contacts 43 are laid out) of the receptacle housing 41, as shown in the oblique view in FIG. 6. Consequently, the board connector 46*f* is exposed to the outside of the receptacle housing 41, as shown in the oblique views in FIGS. 6 and 7.

The board connector 46*f* and the other end of the first connecting member 46*a* exposed to the outside of the receptacle housing 41 are soldered (connected) to a metal layer (for example, a conductive path and/or the like) of the circuit board B positioned on the outside of the receptacle housing 41. Hence, the lock members 44 are firmly connected to the circuit board B.

In addition, the first connecting member 46*a* and the second connecting member 46*b*, that is to say the connecting member 46, is soldered to a metal layer (for example, a conductive path and/or the like) of the circuit board B in a state covering a portion of the receptacle housing 41 along with the lock section 45, as shown in the oblique views in FIGS. 6 and 7. Hence, the connecting member 46 firmly anchors the receptacle housing 41 to the circuit board B.

In addition, the lock members 44, that is to say the lock section 45 and the connecting member 46, are positioned between the ends of the block 42 on which the receptacle contacts 43 are laid out. Consequently, compactness of the electrical connector 10 is possible in comparison to an electrical connector in which the connecting member 46 and the lock section 45 are positioned on the outside of the receptacle housing 41.

In the circuit board B, a hole B1 (a hole whose axis center is along the z axis) for inserting the general-purpose screw G that locks with the lock section 45, as shown in the oblique view in FIG. 2, is provided at a position corresponding to the penetrating hole 42*a* of the block 42.

When the above-described plug connector 20 and the receptacle connector 40 are interlocked, the operator causes the plug connector mounted on the flexible board A, for example, to directly face the receptacle connector 40 mounted on the circuit board B, for example, as shown in the oblique views in FIGS. 1 and 2.

Figure 10:
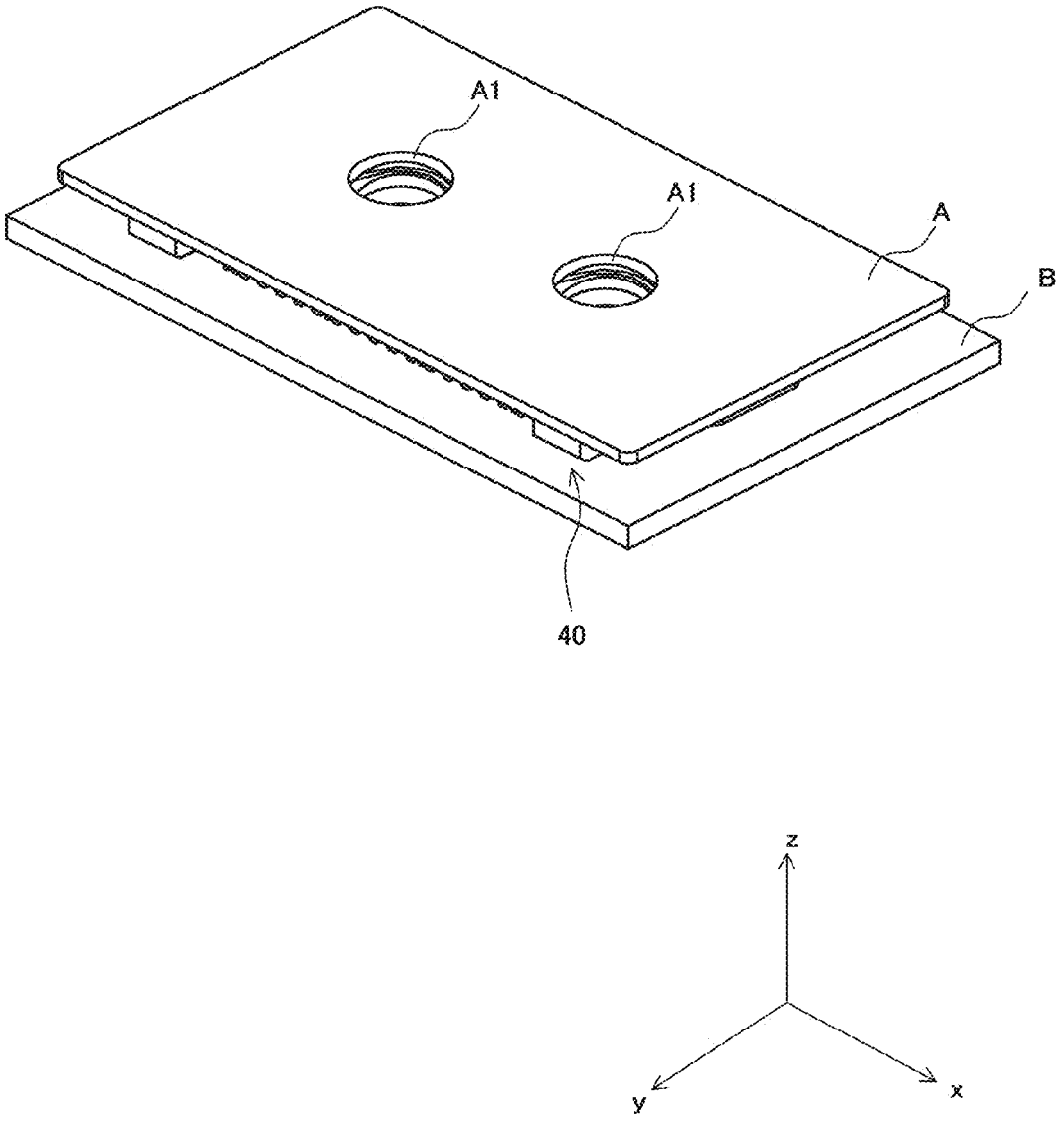
FIG. 10 is an oblique view of when the plug connector is interlocked with the receptacle connector.
Figure 11:
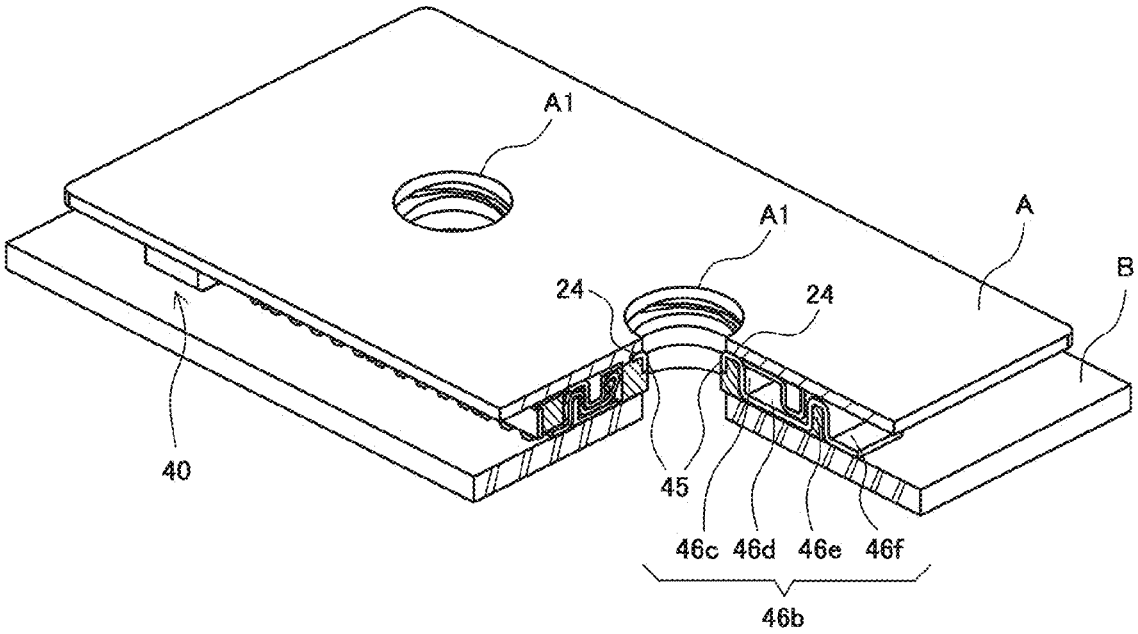
FIG. 11 is an oblique view, partially cut away for convenience, of the plug connector when interlocked with the receptacle connector.
Figure 11:
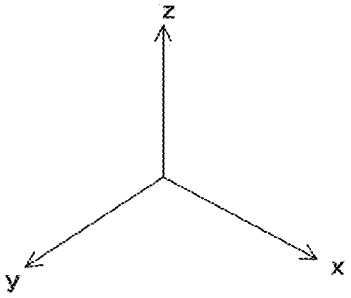

Then, the operator causes the plug housing 21 to interlock with the receptacle housing 41, as shown in the oblique views in FIGS. 10 and 11 (a portion of the electrical connector 10 and/or the like shown in FIG. 10 is cut away for convenience).

Following this, the operator inserts the general-purpose screw G into the compartment 24 and the hole A1 formed in the flexible board A. Then, the operator turns the general-purpose screw G with a screwdriver, causing the tip of the general-purpose screw G to make direct contact with the opening of the lock section 45.

Figure 3:
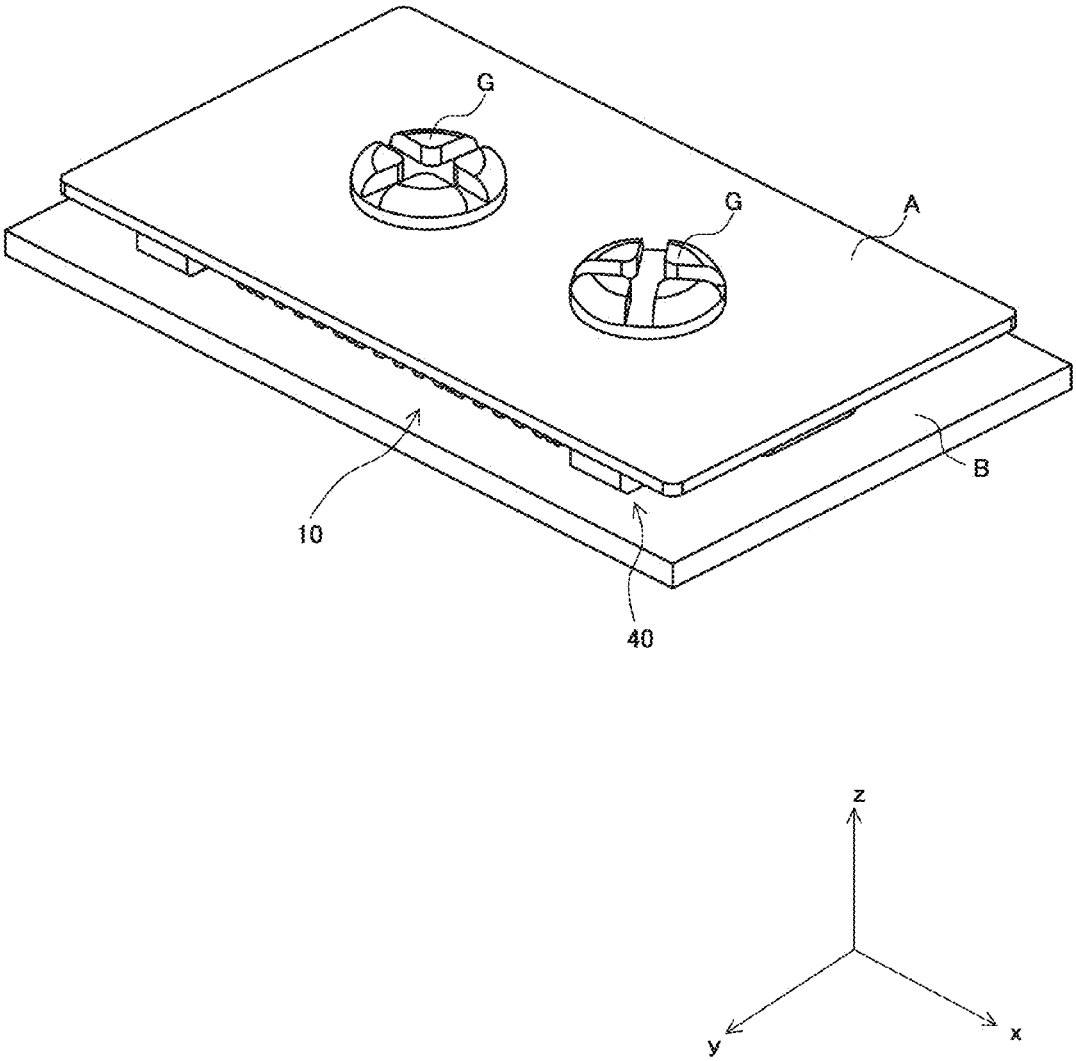
FIG. 3 is an oblique view of the plug connector and the receptacle connector when screwed together.
Figure 12:
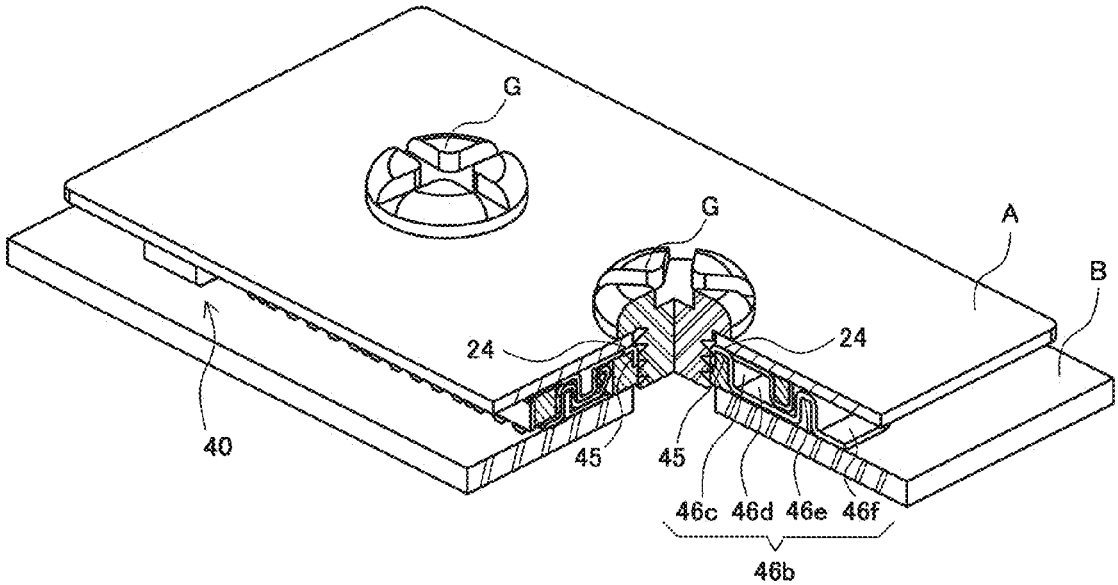
FIG. 12 is an oblique view, partially cut away for convenience, of the plug connector and the receptacle connector when screwed together.
Figure 12:
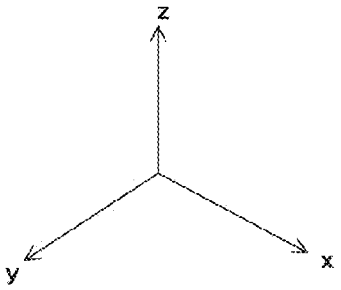

Through this, the general-purpose screw G and the lock section 45 lock, as shown in the oblique views in FIGS. 3 and 12 (a portion of the electrical connector 10 and/or the like shown in FIG. 3 is cut away for convenience). Accordingly, the interlocking state (locked state) of the plug connector 20 and the receptacle connector 40 is maintained by the general-purpose screw G. The tip of the general-purpose screw G is in a state inserted into the hole B1.

At this time, the lock section 45 is held in the compartment 24, as shown in the oblique view in FIG. 12. Hence, the electrical connector 10 in which the interlocking state (locked state) between the plug connector 20 and the receptacle connector 40 is maintained can be made low-profile (it is possible to control the height of the electrical connector 10 in the z direction).

When the plug connector 20 and the receptacle connector 40 are interlocked, the plug contacts 22 and the receptacle contacts 43 are in direct contact. Hence, the plug contacts 22 and the receptacle contacts 43 are electrically connected, and the flexible board A and the circuit board B are electrically connected.

Following this, in order to exchange the plug connector 20, for example, when releasing the interlocking of the plug connector 20 and the receptacle connector 40, the operator turns the general-purpose screw G locked into the lock section 45 in the opposite direction as when locking, using a screwdriver.

Whereupon, the lock between the general-purpose screw G and the lock section 45 is released. Following this, the operator removes the general-purpose screw G from the compartment 24 and the hole A1. Through this, the interlocking state (locked state) of the plug connector 20 and the receptacle connector 40 is released. At this time, the electrical connector 10 achieves the state shown in FIG. 10. In this state, the operator separates the plug connector 20 from the receptacle connector 40 and exchanges the plug connector 20, for example.

As described above, with the electrical connector 10 according to this exemplary embodiment, when the plug connector 20 and the receptacle connector 40 are to be interlocked, it is fine for the operator to insert the general-purpose screw G into the compartment 24 and the hole A1, and to cause locking of the general-purpose screw G with the lock section 45 connected to the circuit board B via the first connecting member 46*a* and the second connecting member 46*b*. On the other hand, when releasing the interlocking state (locked state) of the plug connector 20 and the receptacle connector 40, it is fine for the operator to release the lock between the general-purpose screw G and the lock section 45 by turning the general-purpose screw G with a screwdriver, and to remove the general-purpose screw G from the compartment 24 and the hole A1. Hence, with the electrical connector 10 according to this exemplary embodiment, in addition to it being possible to maintain with certainty interlocking of the plug connector 20 and the receptacle connector 40, it is easy to release the interlocking of the plug connector 20 and the receptacle connector 40.

Further, when the electrical connector 10 according to this exemplary embodiment is such that the plug connector 20 and the receptacle connector 40 are in an interlocking state (locked state), the lock section 45 is held in the compartment 24. Hence, with the electrical connector 10 according to this exemplary embodiment, it is possible to control the height in the z direction when the connectors are interlocked (it is possible to lower the profile).

Furthermore, in the electrical connector 10 according to this exemplary embodiment, the pair of lock members 44 is positioned between the ends of the block 42 on which the receptacle contacts 43 are laid out. Hence, with the electrical connector 10 according to this exemplary embodiment, it is possible to achieve compactness of the electrical connector 10 in comparison to an electrical connector in which the pair of lock members 44 is positioned on the outside of the receptacle housing 41.

Yet furthermore, in the electrical connector 10 according to this exemplary embodiment, the pair of lock members 44 is positioned in facing positions. Hence, it is possible to anchor the receptacle housing 41 to the circuit board B firmly and with good balance.

Moreover, in the electrical connector 10 according to this exemplary embodiment, both the board connector 46*f* of the second connecting member 46*b* and other end of the first connecting member 46*a* positioned facing each other so as to interpose the lock section 45 are soldered to a metal layer (for example, a conductive path and/or the like) of the circuit board B.

Consequently, it is possible for force applied to the lock section 45 at the time of rotation of the general-purpose screw G to be dispersed and not concentrated at a specific single location of the receptacle housing 41.

Accordingly, even if the number of times of interlocking and releasing interlocking of the general-purpose screw G and the lock section 45 accumulates, and the number of times force is applied to the lock section 45 from the general-purpose screw G, it is possible to prevent the other end of the first connecting member 46*a* and the board connector 46*f* from separating from the metal layer (for example, a conductive path and/or the like) of the circuit board B, and as a result, it is possible to prevent the lock section 45 from separating from the receptacle housing 41.

Above, the exemplary embodiment of the present disclosure was described, but this is intended to be illustrative and not limiting, for various variations and applications are possible.

In the electrical connector 10 according to the above-described exemplary embodiment, a compartment 24 was provided in the plug connector 20 and a lock member 44 (lock section 45 and connecting member 46) was provided in the receptacle connector 40, but this is intended to be illustrative and not limiting.

It would be fine for the lock member 44 to be provided in the plug connector 20 and for the compartment 24 to be provided in the receptacle connector 40. Even in the case of this composition, when the interlocking state (locked state) between the plug connector 20 and the receptacle connector 40 is released, it is fine for the operator to turn the general-purpose screw G using a screwdriver, release the lock between the general-purpose screw G and the lock section 45, and remove the general-purpose screw G from the compartment 24 and the hole B1. Consequently, releasing interlocking of the plug connector 20 and the receptacle connector 40 is easy.

In addition, in the electrical connector 10 according to the above-described exemplary embodiment, grooves for realizing engagement (locking) with the general-purpose screw G were formed in advance in the inner wall of the lock section 45, but this is intended to be illustrative and not limiting. That is to say, it would be fine if grooves were not formed in advance in the inner wall of the lock section 45. In the case of this composition, when the operator initially screws the general-purpose screw G into the lock section 45, grooves are formed in the inner wall of the lock section 45 by the general-purpose screw G scraping the inner wall of the locking section 45.

In addition, when grooves are not formed in advance in the inner wall of the lock section 45, it would be fine to have the following kind of composition. That is to say, the lock section 45 comprises, in the inner wall, protrusions protruding toward the axis center. In addition, in place of the general-purpose screw G a lock member comprising a head and shaft similar to the general-purpose screw G is used, and on the shaft, indentations indented toward the inside are formed.

In the case of this composition, when the lock member is inserted into the opening of the lock section 45, the protrusions formed on the inner wall of the lock section 45 and the indentations formed on the shaft of the lock member engage with each other. Consequently, the plug connector 20 and the receptacle connector 40 can maintain the interlocking state (locked state).

On the other hand, when releasing the interlocking state (locked state) between the plug connector 20 and the receptacle connector 40, the operator manually removes, for example, the lock member locked with the lock section 45. Through this, engagement of the lock member and the lock section 45 is released, and interlocking of the plug connector 20 and the receptacle connector 40 is released.

In this manner, even using the lock section 45 and the lock member having the above-described composition, releasing interlocking between the plug connector 20 and the receptacle connector 40 is easy.

In addition, the electrical connector 10 according to the above-described exemplary embodiment comprised a pair of lock members 44 (lock section 45 and connecting member 46). In other words, the electrical connector 10 comprised two lock members 44.

However, this is intended to be illustrative and not limiting. It would be fine for the electrical connector 10 to comprise three, for example, lock members 44 (lock section 45 and connecting member 46). In addition, it would be fine for the electrical connector 10 to comprise one lock member 44.

Figure 13:
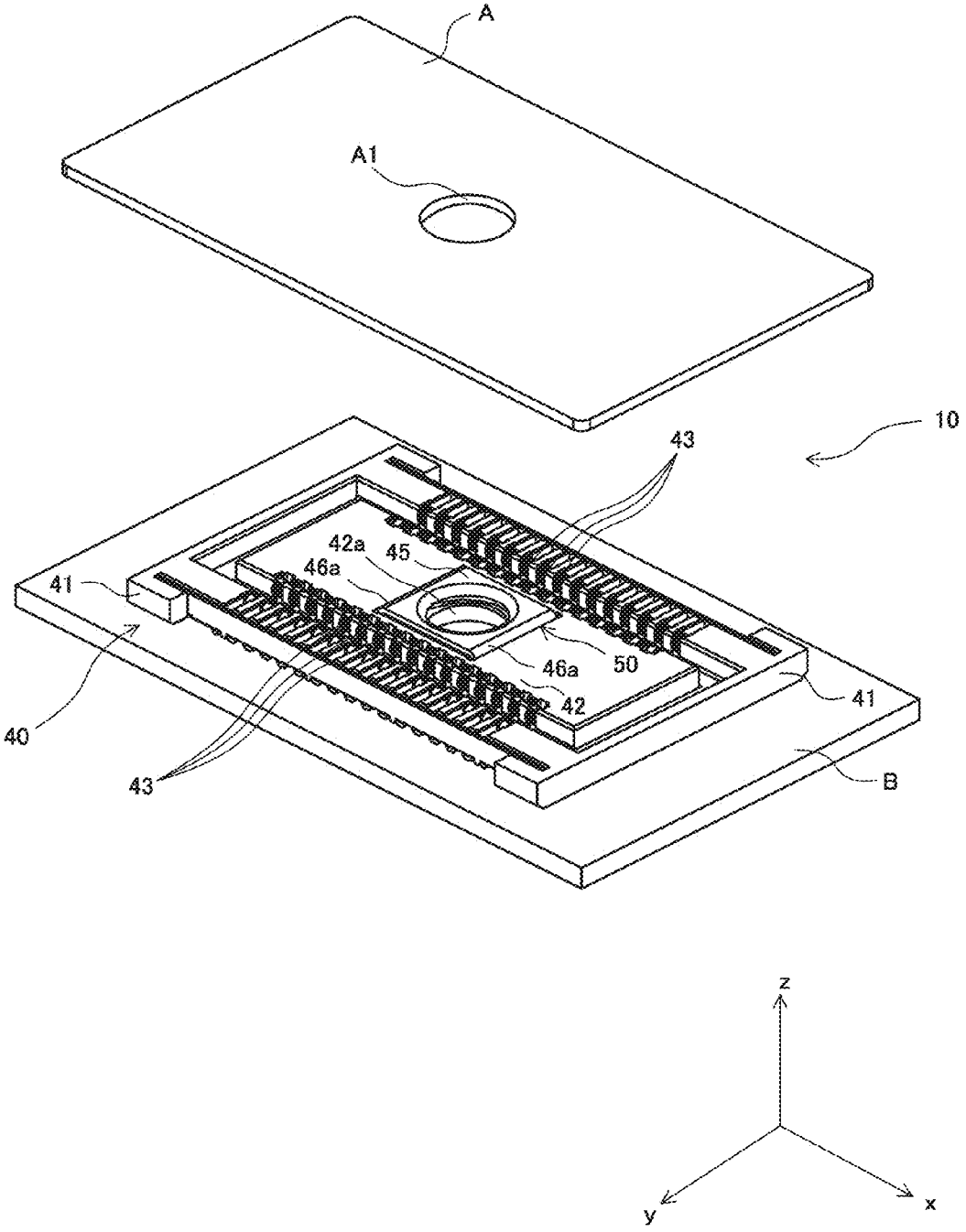
FIG. 13 is a first oblique view of an electrical connector provided with one lock member, when mounted on a circuit board.
Figure 14:
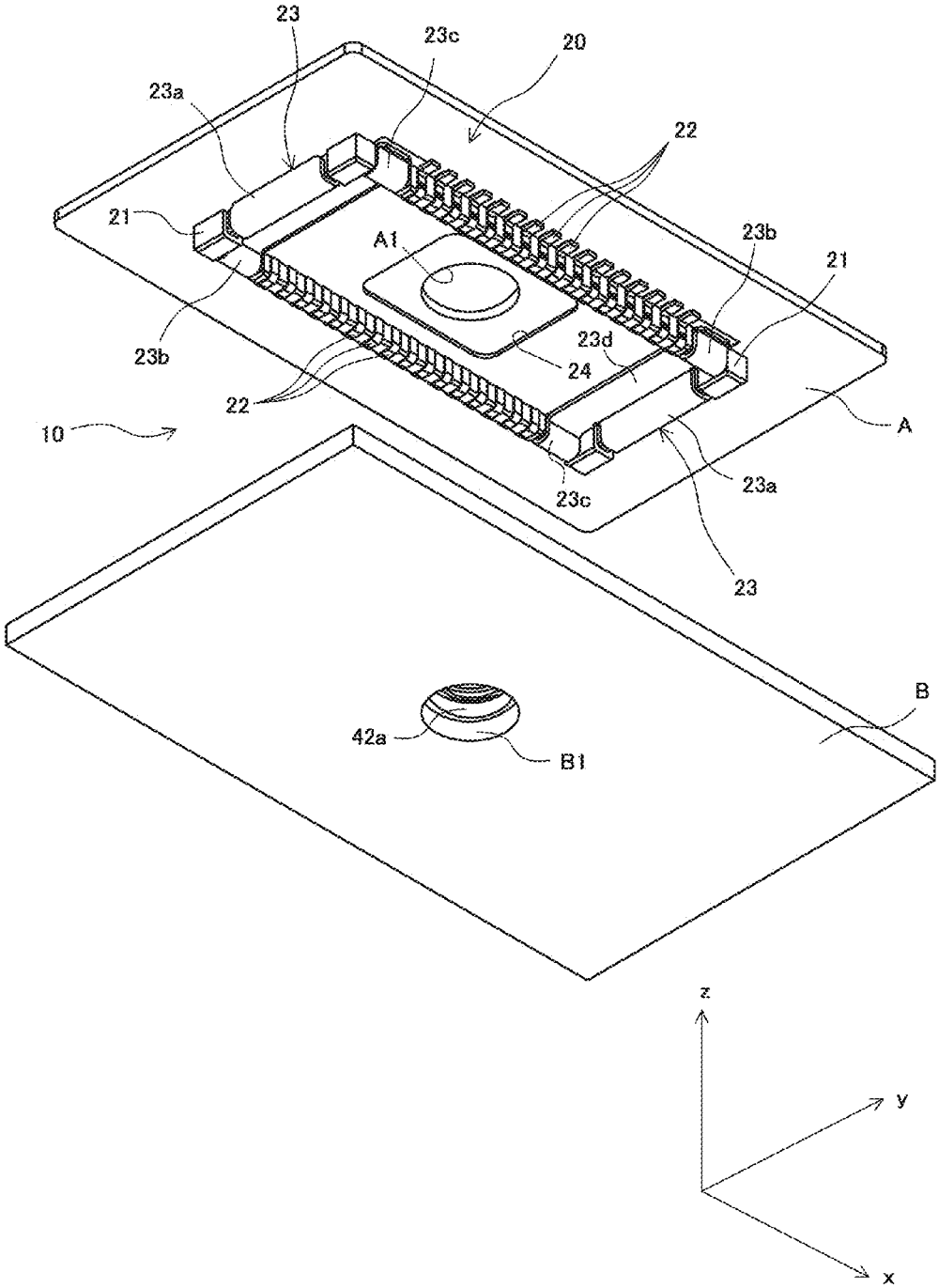
FIG. 14 is a second oblique view of an electrical connector provided with one lock member, when mounted on a circuit board.

For example, the electrical connector 10 when comprising one lock member is shown in the oblique views in FIGS. 13 and 14. The electrical connector 10 of this composition comprises a lock member 50. In the case of this composition, a hole A1 is provided in the center section, for example, of the flexible board A.

In addition, the lock member 50 is positioned in the center section, for example, of the block 42. Specifically, the penetrating hole 42*a* is provided in the center section, for example of the block 42, and the inner wall of the lock section 45 is inserted into the penetrating hole 42*a*. In addition, the hole B1 is provided in the circuit board B in a position corresponding to the penetrating hole 42*a*.

Furthermore, as shown in the oblique view in FIG. 14, the compartment 24 is provided in the center section, for example, of the plug housing 21. In addition, in the flexible board A, the hole A1 is provided at a position corresponding to the opening of the lock section 45.

Figure 15:
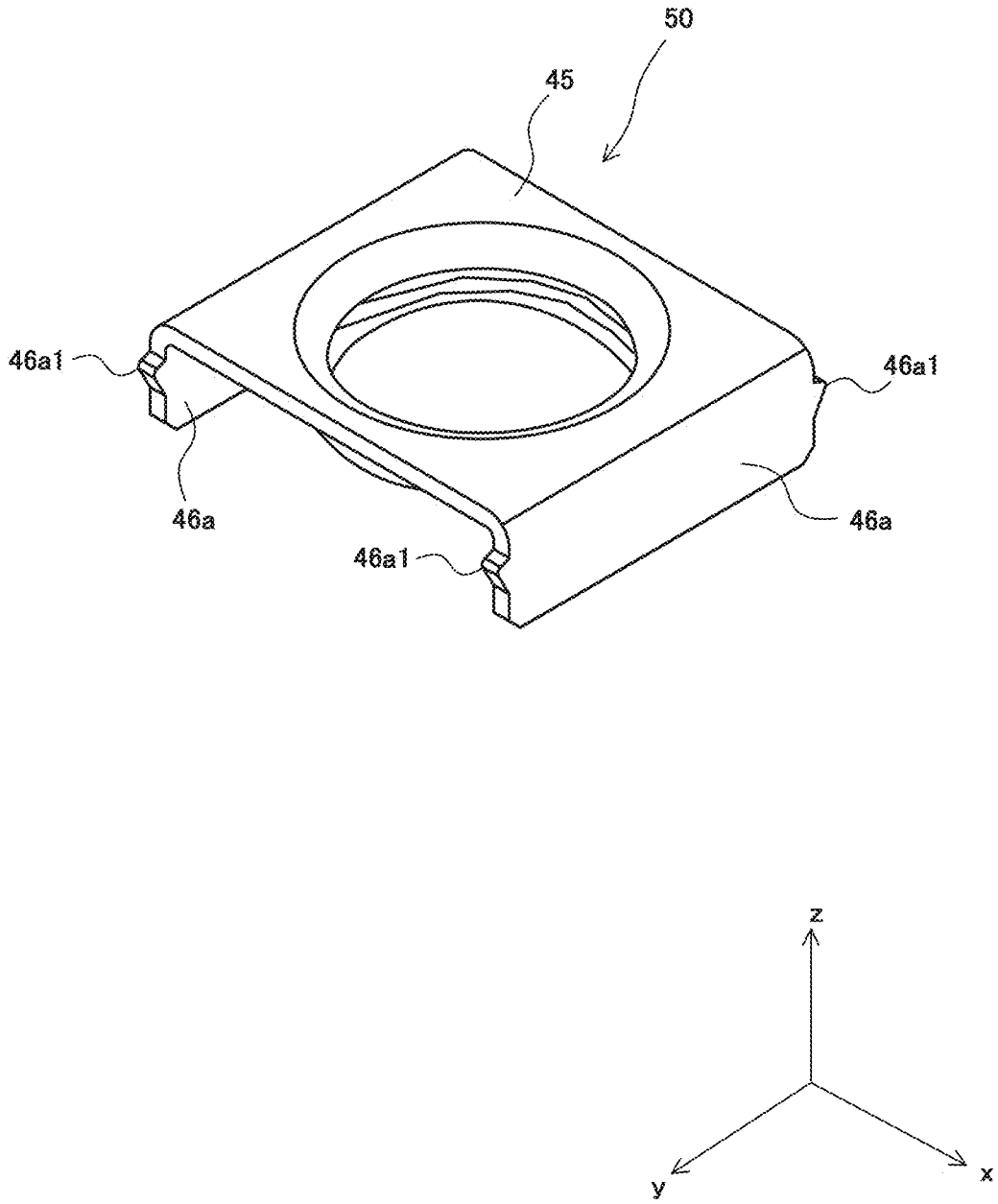
FIG. 15 is an oblique view of the lock member with which the electrical connector shown in FIGS. 13 and 14 is provided.

The lock member 50 comprises a pair of first connecting member 46*a* at both ends of the lock section 45 facing each other so as to interpose the lock section 45 between, as shown in the oblique view in FIG. 15. One end of one of the first connecting members 46*a* is connected to one end of the lock section 45, and one end of the other first connecting member 46*a* is connected to the other end of the lock section 45. Furthermore, the other ends of the one and the other first connecting members 46*a* are exposed to the outside of the receptacle housing 41 and are soldered to a metal layer (for example, a conductive path) of the circuit board B. That is to say, the pair of first connecting members 46*a* is soldered to a metal layer (for example, a conductive path) of the circuit board B in a state covering a portion of the receptacle housing 41 along with the lock section 45.

With the electrical connector 10 comprising the above-described lock member 50 as well, when releasing the interlocking state (locked state) between the plug connector 20 and the receptacle connector 40, it is fine for the operator to turn the general-purpose screw G with a screwdriver, release the lock between the general-purpose screw G and the lock section 45 and pull out the general-purpose screw G from the compartment 24 and the hole B1. Consequently, releasing interlocking of the plug connector 20 and the receptacle connector 40 is easy.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

REFERENCE SYMBOLS

10 Electrical connector, 20 Plug connector, 21 Plug housing, 22 Plug contacts, 23 Anchoring member, 23*a* to 23*c* Overhang, 23*d* Plate, 24 Compartment, 40 Receptacle connector, 41 Receptacle housing, 42 Block, 42*a* Penetrating hole, 42*b* Penetrating groove, 42*c* Protrusions, 43 Receptacle contacts, 44, 50 Lock member, 45 Lock section, 46 Connecting member, 46*a* First connecting member, 46*a*1, 46*c*1 Protrusion, 46*b* Second connecting member, 46*c* Standing plate, 46*d* Foundation, 46*e* Overhang, 46*f* Board connector, A Flexible board, B Circuit board, A1, B1 Hole, G General-purpose screw.

What is claimed is:

1. An electrical connector comprising:

a first connector possessing a first housing forming an interior region with an insulating wall, and first contacts, laid out on both ends of the first housing, that are conductive members extending toward the outside of the first housing from the wall of the interior region; and a second connector possessing a second housing made up of an insulating wall at least a portion of which is positioned within the interior region of the first housing, and second contacts, laid out on both ends of the second housing corresponding to the layout of the first contacts, that are conductive members extending toward the outside of the second housing from the wall of the second housing, wherein the first housing and the second housing are interlocked and through this the first contacts and the second contacts are electrically connected, and into one housing the other housing interlocks, and a penetrating hole into which a lock member for maintaining the interlocking state between the connectors is insertable and from which the inserted lock member is removable when releasing the interlocking state is formed in the other housing, the electrical connector further comprising:

a lock section attached at a position corresponding to the penetrating hole in an inner region surrounded by an outer frame formed by the wall of the one housing facing the other housing when the connectors are interlocked with each other, and composed so as to be lockable with the lock member inserted into the penetrating hole; and a connecting member that is a pair of members attached to both ends of the lock section facing each other so as to interpose the lock section in between, and is connected to a circuit board positioned on the outside of the one housing in a state covering a portion of the one housing along with the lock section.

2. The electrical connector according to claim 1, wherein a compartment forming a hole for holding the lock section when the connectors are interlocked with each other is provided in the other housing.

3. The electrical connector according to claim 1, wherein the lock member is a screw, and a groove into which the screw is lockable is formed in the lock section.

4. The electrical connector according to claim 1, wherein the lock section and the connecting member are integrally formed, and the connector comprises at least two of the integrally formed lock sections and connecting members at opposite positions.

* * * * *